US007290762B2

(12) United States Patent
Connors et al.

(10) Patent No.: US 7,290,762 B2
(45) Date of Patent: Nov. 6, 2007

(54) PRINT MEDIA SOURCE FOR AN IMAGING APPARATUS

(75) Inventors: William Michael Connors, Lexington, KY (US); Victor David Hair, Lexington, KY (US); Tommy Otis Lowe, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 484 days.

(21) Appl. No.: 10/791,505

(22) Filed: Mar. 1, 2004

(65) Prior Publication Data

US 2005/0206070 A1 Sep. 22, 2005

(51) Int. Cl.
*B65H 3/44* (2006.01)

(52) U.S. Cl. ..... 271/9.07; 271/9.01; 271/171; 271/145

(58) Field of Classification Search ..... 271/9.01, 271/9.07, 9.09, 9.11, 9.12, 9.13, 171, 145
See application file for complete search history.

(56) References Cited

U.S. PATENT DOCUMENTS 3,989,236 A * 11/1976 Komori et al. ..... 271/4.1
4,363,477 A * 12/1982 Miyashita ..... 271/9.09
4,429,863 A * 2/1984 Itoh et al. ..... 271/9.09
4,871,160 A * 10/1989 Yoshino ..... 271/9.02
5,287,164 A * 2/1994 Watanabe ..... 399/391
6,152,440 A 11/2000 Yip et al.
6,227,533 B1 * 5/2001 Jang ..... 271/109
6,612,564 B1 9/2003 Todd
6,629,693 B2 10/2003 Siow et al.
2002/0101024 A1 8/2002 Billings et al.

FOREIGN PATENT DOCUMENTS

JP 56-145043 * 11/1981
JP 5-32332 * 2/1993

* cited by examiner

*Primary Examiner*—Patrick Mackey
*Assistant Examiner*—Thomas Morrison
(74) *Attorney, Agent, or Firm*—Taylor & Aust, P.C.

(57) ABSTRACT

An imaging apparatus includes a printing mechanism and a print media source for supplying print media sheets to the printing mechanism. The print media source includes a first media tray for holding a first print media, a second media tray for holding a second print media, and a sheet feeder mechanism having a sheet picking roller located to pick a top sheet of print media in the print media source, the top sheet of print media being located in one of the first media tray and the second media tray.

6 Claims, 6 Drawing Sheets

PRINT MEDIA SOURCE FOR AN IMAGING APPARATUS

BACKGROUND OF THE INVENTION

1. Field of the Invention

The present invention relates to an imaging apparatus, and, more particularly, to a print media source for an imaging apparatus, such as an ink jet printer.

2. Description of the Related Art

An imaging apparatus, such as an ink jet printer, includes a print media source that may include multiple media trays, each including its own automatic sheet feeder (ASF) for selectively feeding a sheet of print media from the selected source. Inclusion of a dedicated ASF for each print media tray adds to the cost of an imaging apparatus, and thus, may not be economically feasible for use in a lower cost imaging apparatus. Further, having an ASF for each print media tray adds to the size and complexity of an imaging apparatus.

A lower cost imaging apparatus, in contrast, typically includes only one print media tray, so if a user wants to change print media, such as for example, from A4 paper size to envelopes, the first print media (i.e., the A4 media) is removed and replaced with the second print media (i.e., envelopes). Such a process, however, can be cumbersome, and risks damage to print media each time it is removed and then reinserted.

What is needed in the art is an imaging apparatus that can simultaneously hold multiple print media types, yet needs only a single sheet feeder mechanism for feeding print media from any selected one of multiple print media trays that the user desires to use.

SUMMARY OF THE INVENTION

The present invention provides an imaging that can simultaneously hold multiple print media trays, yet needs only a single automatic sheet feeder for feeding print media from any selected one of the multiple print media trays that the user desires to use.

The invention, in one form thereof, is directed to an imaging apparatus including a printing mechanism and a print media source for supplying print media sheets to the printing mechanism. The print media source includes a first media tray for holding a first print media, a second media tray for holding a second print media, and a sheet feeder mechanism having a sheet picking roller located to pick a top sheet of print media in the print media source, the top sheet of print media being located in one of the first media tray and the second media tray.

The invention, in another form thereof, is directed to an imaging apparatus, including a printing mechanism and a print media source for supplying print media sheets to the printing mechanism. The print media source includes a first media tray for holding a first print media, a second media tray for holding a second print media, and a sheet feeder mechanism having a sheet picking roller. The sheet picking roller is biased in a first direction to pick a sheet of print media from the first media tray and the sheet picking roller is biased in the first direction to pick a sheet of print media from the second media tray.

In still another form thereof, the invention is directed to an imaging apparatus including a frame, a primary media tray for holding a primary print media, and an auxiliary media tray pivotably coupled to the frame. The auxiliary media tray is configured for holding a second print media.

An advantage of the present invention is that the imaging apparatus can simultaneously hold multiple print media types, yet needs only a single sheet feeder mechanism for feeding print media from any selected one of multiple print media trays that the user desires to use.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
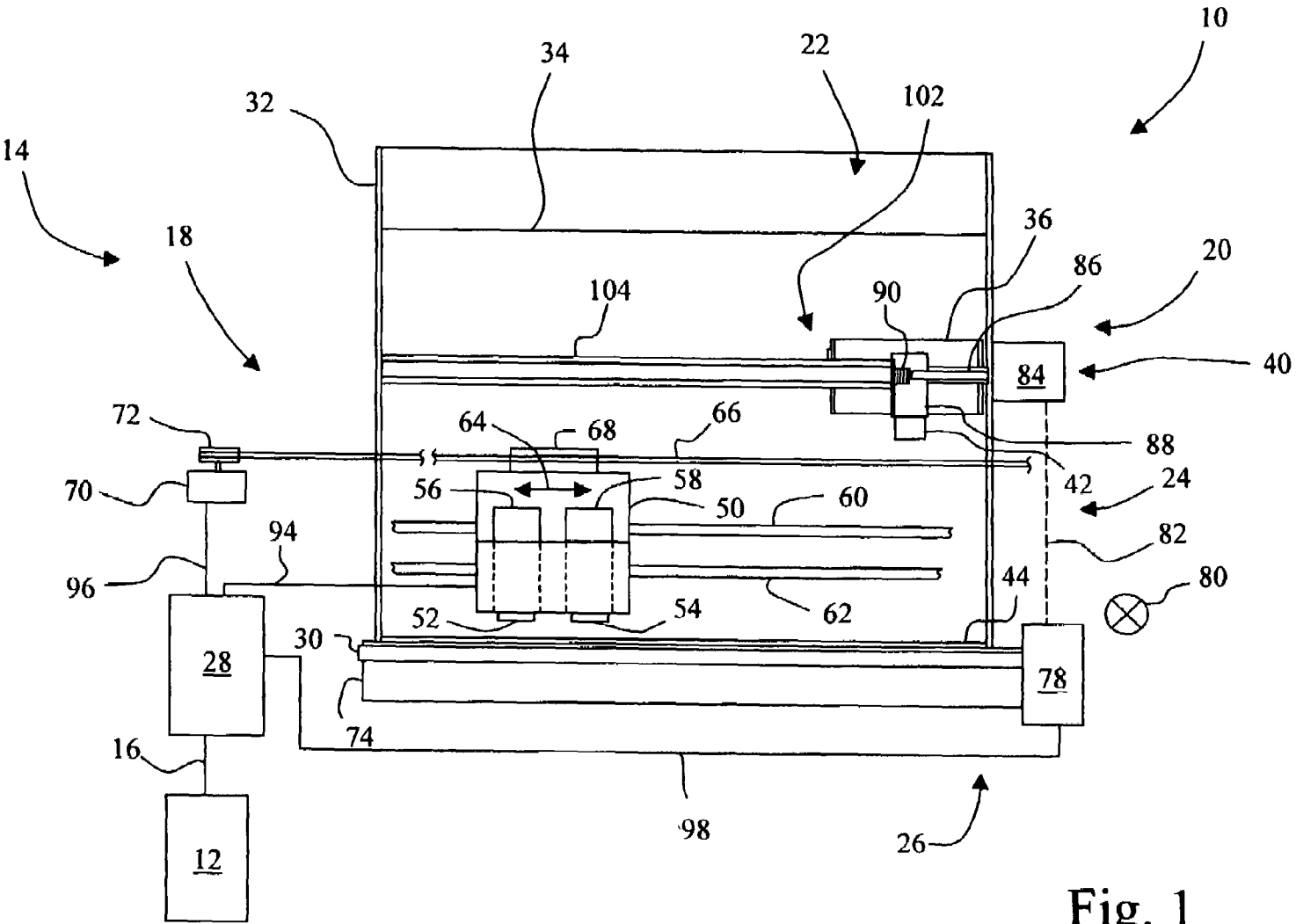
FIG. 1 is a diagrammatic representation of an imaging system including an imaging apparatus embodying the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of an ink jet printer 14 as shown. Thus, for example, ink jet printer 14 may be a conventional ink jet printer, or may form the print engine for a multi-function apparatus, such as for example, a standalone unit that has faxing and copying capability, in addition to printing.

Host 12, which may be optional, may be communicatively coupled to imaging apparatus 14 via a communications link 16. Communications link 16 may be, for example, a direct electrical connection, a wireless connection, or a network connection.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

Figure 2:
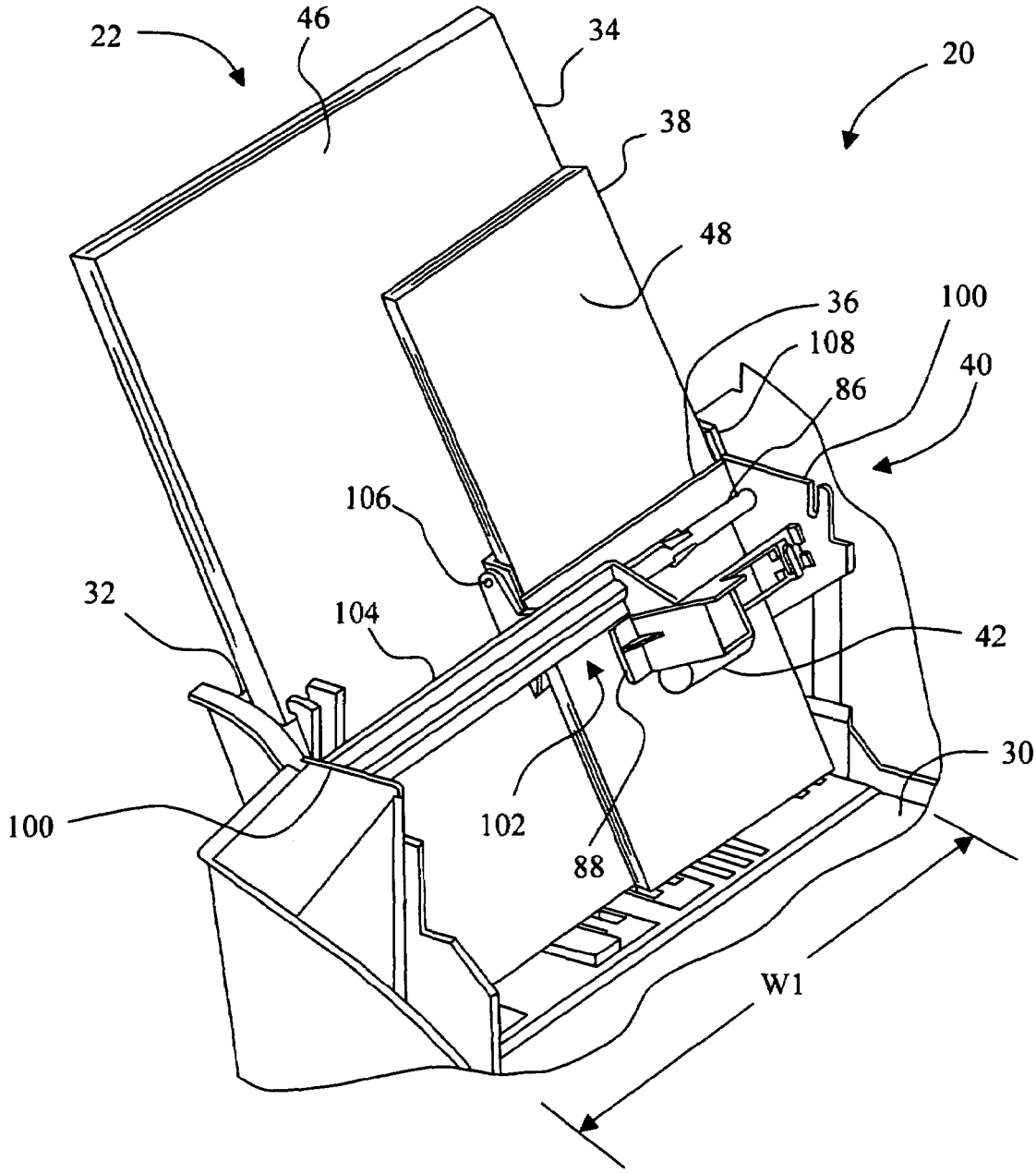
FIG. 2 is a perspective front view of the print media source for the imaging apparatus of FIG. 1.

Imaging apparatus 14 includes a printing mechanism 18, such as for example an ink jet print engine, and a print media source 20 for supplying print media 22 in the form of print media sheets to printing mechanism 18. Printing mechanism 18, when in the form of an ink jet print engine, includes a printhead carrier system 24, a feed roller unit 26, a controller 28, and a mid-frame 30. With further reference to FIG. 2, print media source 20 includes a primary media tray 32 for holding a primary print media 34, a secondary (or auxiliary) media tray 36 for holding a secondary print media 38, and a sheet feeder mechanism 40 having a sheet picking roller 42. Sheet picking roller 42 is located to pick a top sheet 44 (see also, e.g., FIGS. 3 and 5) of print media 22 located in print media source 20, wherein top sheet 44 of print media 22 is located in one of primary media tray 32 and secondary media tray 36.

Top sheet 44 is then transported to feed roller unit 26, which in turn further transports top sheet 44 during a printing operation over mid-frame 30, which provides support for top sheet 44 during a printing operation. Top sheet 44 may be, for example, plain paper, coated paper, photo paper, transparency media or envelopes, of various sizes, depending on which of media trays 32, 36 contains top sheet 44. For example, with reference to FIGS. 4 and 5, primary media tray 32 may contain A4 sized plain paper as primary print media 34, and top sheet 44 thus may be the upper media sheet 46 of primary print media 34 in primary media tray 32. However, if a user desires to print envelopes as secondary print media 38, for example, with reference to FIGS. 2 and 3, then the envelopes are loaded into secondary media tray 36 and the upper media sheet 48 of secondary print media 38 becomes top sheet 44. To resume printing from primary media tray 32, then the secondary print media 38 is removed from secondary media tray 36.

Referring again to FIG. 1, printhead carrier system 24 includes a printhead carrier 50 for mounting and carrying a printhead 52, e.g., a color printhead, and/or a printhead 54, e.g., a monochrome or photo color printhead. An ink reservoir 56, which may include color inks, is provided in fluid communication with printhead 52. An ink reservoir 58, which may include a monochrome ink or photo color inks, is provided in fluid communication with printhead 54. Those skilled in the art will recognize that printhead 52 and ink reservoir 56 may be formed as individual discrete units, or may be combined as an integral unitary printhead cartridge. Likewise, printhead 54 and ink reservoir 58 may be formed as individual discrete units, or may be combined as an integral unitary printhead cartridge.

Printhead carrier 50 is guided by a pair of guide members 60, 62, such as for example, guide rods, which generally define a bi-directional scanning path 64 for printhead carrier 50. Printhead carrier 50 is connected to a carrier transport belt 66 via a carrier drive attachment device 68. Carrier transport belt 66 is driven by a carrier motor 70 via a carrier pulley 72.

At the directive of controller 28, printhead carrier 50 is transported in a reciprocating manner along guide members 60, 62. Carrier motor 70 can be, for example, a direct current (DC) motor or a stepper motor.

Figure 3:
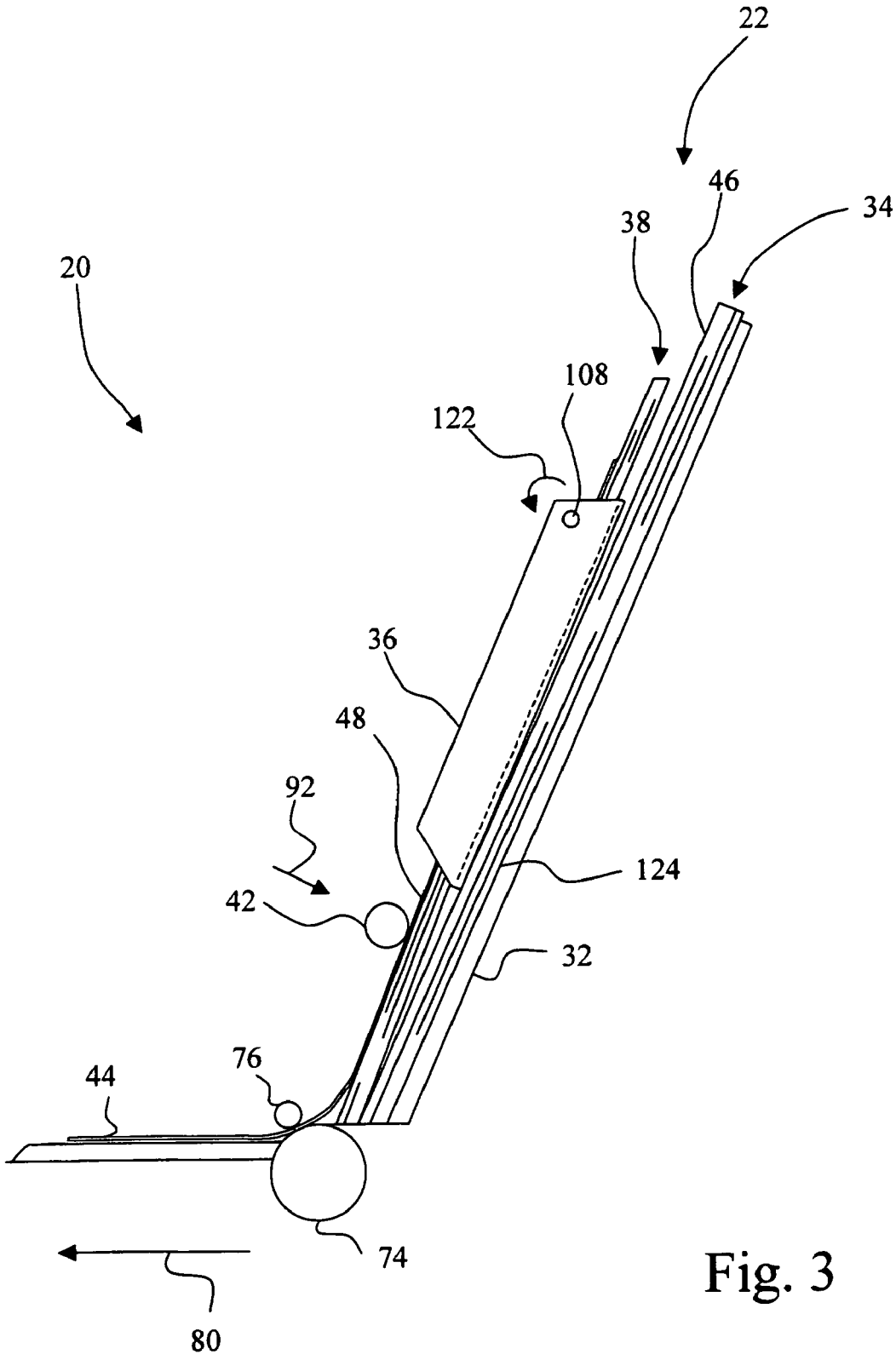
FIG. 3 is a side diagrammatic representation of a portion of the print media source depicted in FIG. 2.
Figure 5:
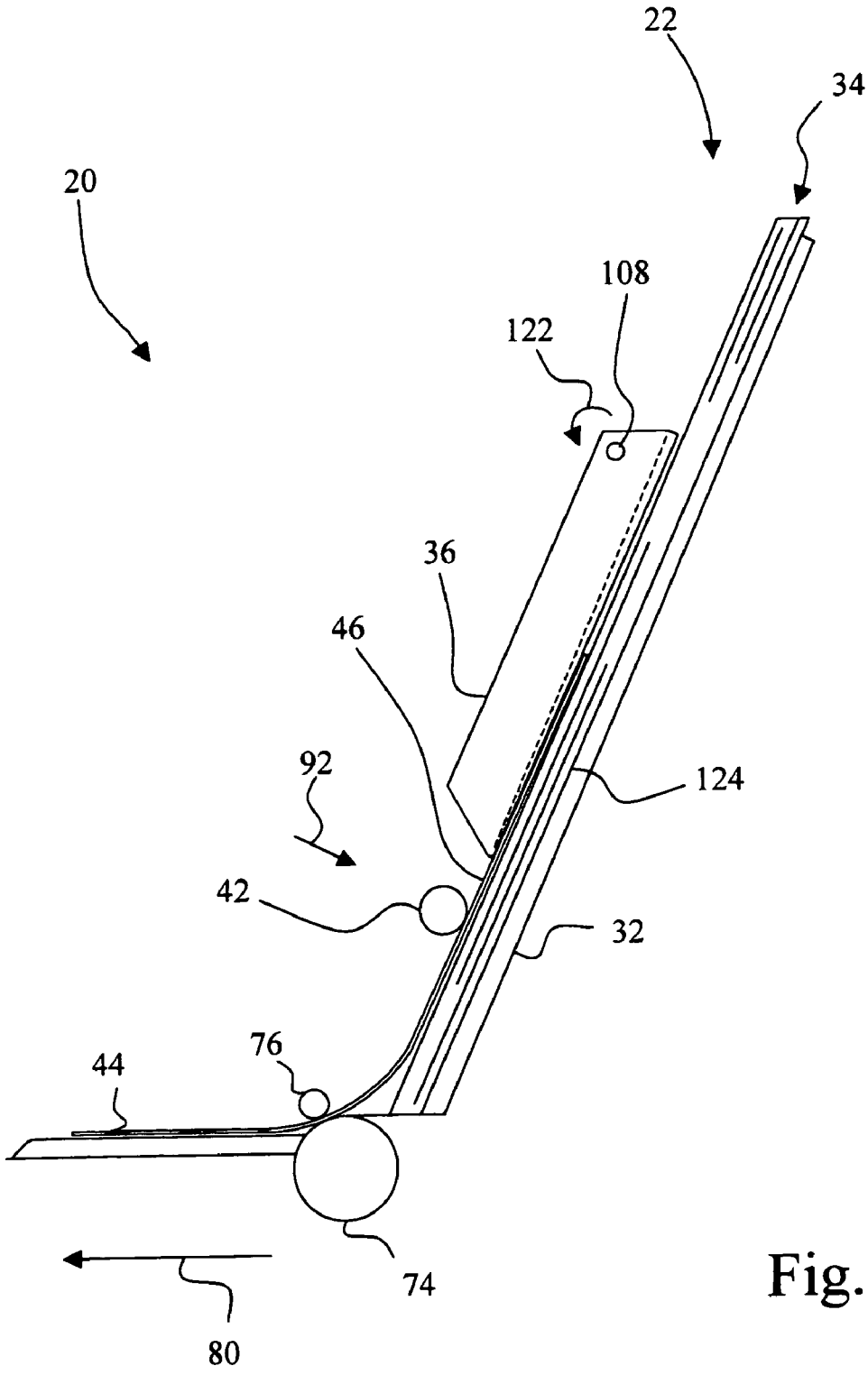
FIG. 5 is a side diagrammatic representation of a portion of the print media source depicted in FIG. 4.

Referring to FIGS. 1, 3 and 5, feed roller unit 26 includes, for example, a feed roller 74, pinch rollers 76 and a drive unit 78. Feed roller 74 is driven by drive unit 78, and pinch rollers 76 apply a biasing force to hold the media sheet 44 in contact with respective driven feed roller 74. Drive unit 78 includes a drive source, such as for example a direct current (DC) motor, and an associated drive mechanism, such as a gear train or belt/pulley arrangement. Feed roller unit 26 feeds the media sheet 44 in a sheet feed direction 80, designated as an X in a circle in FIG. 1 to indicate that the sheet feed direction is out of the plane of FIG. 1 toward the reader. The sheet feed direction 80 is commonly referred to as the vertical direction, which is perpendicular to the horizontal bi-directional scanning path 64. Thus, with respect to media sheet 44, carrier reciprocation occurs in a horizontal direction and media advance occurs in a vertical direction, and the carrier reciprocation is generally perpendicular to the media advance.

Drive unit 78 may be further used to drive sheet picking roller 42. For example, drive unit 78 may be coupled via a transmission device 82 (represented by a dashed line), such as by a belt or gear train, to a sheet pick drive unit 84. In turn, sheet pick drive unit 84 is coupled to a sheet pick roller drive shaft 86, which in turn supports a pivoting arm 88 of sheet feeder mechanism 40, to which sheet picking roller 42 is rotatably attached. Sheet pick roller drive shaft 86 in turn is coupled via a gear train (not shown) located in pivoting arm 88 so as to apply a rotational force to sheet picking roller 42. A spring 90, such as a torsion spring, is positioned to apply a biasing force in direction 92 (see FIGS. 3 and 5) to sheet picking roller 42 via pivoting arm 88.

In this arrangement, in order to pick a sheet of print media, such as top sheet 44, the motor of drive unit 78 may be rotated in a first direction and after media sheet 44 is delivered to feed roller 74, the motor may be reversed to drive feed roller 74 and to cease driving sheet picking roller 42. Alternatively, sheet pick drive unit 84 may include a separate motor as a power source for driving sheet picking roller 42.

Controller 28 is electrically connected and communicatively coupled to printheads 52, 54 via a communications link 94, such as for example a printhead interface cable. Controller 28 is electrically connected and communicatively coupled to carrier motor 70 via a communications link 96, such as for example an interface cable. Controller 28 is electrically connected and communicatively coupled to drive unit 78 via a communications link 98, such as for example an interface cable.

Controller 28 may be formed as an application specific integrated circuit (ASIC), and includes processing capability, which may be in the form of a microprocessor having an associated random access memory (RAM) and read only memory (ROM). Controller 28 executes program instructions to effect the printing of an image on the media sheet 44, such as for example, by selecting the index feed distance of print media sheet 44 as conveyed by feed roller 74, controlling the reciprocation of printhead carrier 50, and controlling the operations of printheads 52, 54. In addition, controller 28 executes instructions to effect the timely picking of top sheet 44 of print media 22 of print media source 20.

Figure 4:
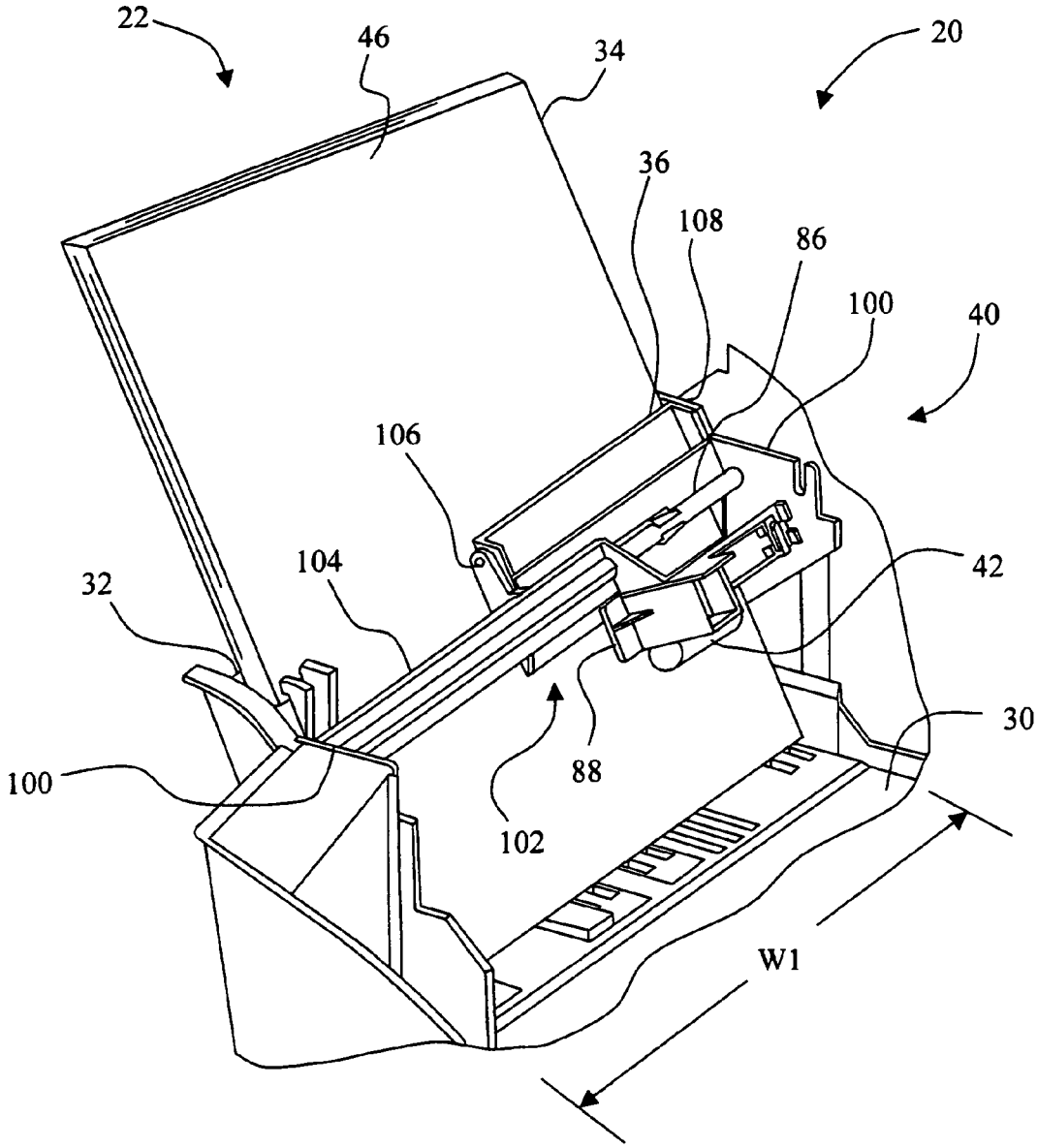
FIG. 4 is another perspective front view of the print media source for the imaging apparatus of FIG. 1.

Referring to FIGS. 1, 2 and 4, imaging apparatus 14 includes a frame 100 having a mounting frame 102. Mounting frame 102 includes a cross support 104 that extends across a width (W1) of primary media tray 32 and is pivotably coupled to frame 100. Cross support 104 is pivotally biased by spring 90. Sheet pick roller drive shaft 86 is rotatably mounted to cross support 104. In addition, secondary media tray 36 is pivotably coupled by pivot joints 106, 108 to mounting frame 102. Each of pivot joints 106, 108 may be formed, for example, by a pin/hole arrangement.

Figure 6:
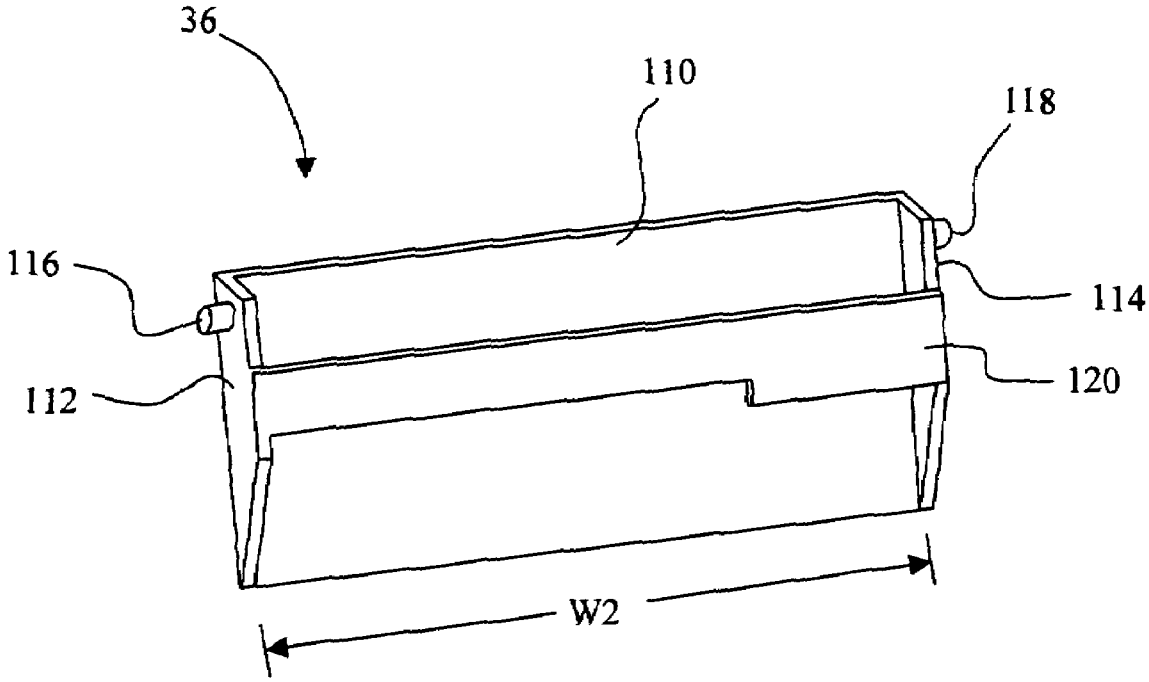
FIG. 6 is a perspective front view of the secondary media tray for the imaging apparatus of FIG. 1.

Referring to FIG. 6, secondary media tray 36 includes a media support 110 serving as a base, from which side walls 112, 114 extend. As shown, side walls 112, 114 are spaced apart horizontally by the extent of media support 110. Extending outwardly from side wall 112 is a pivot pin 116, which forms the pin portion of the pin/hole arrangement of pivot joint 106. Extending outwardly from sidewall 114 is a pivot pin 118, which forms the pin portion of the pin/hole arrangement of pivot joint 108. A cross member 120 bridges across the width (W2) of secondary media tray 36 to connect to each of the vertical extents of side walls 112, 114, to provide support thereto. Secondary print media 38 is loaded into secondary media tray 36 between media support 110 and cross member 120.

Referring again to FIGS. 3 and 5, secondary media tray 36 pivots in direction 122 at pivot joints 106, 108 to contact upper media sheet 46 of primary print media 34 in primary media tray 32 when primary print media 34 is present in primary media tray 32. In the absence of said primary print media 34 in primary media tray 32, however, secondary media tray 36 pivots at pivot joints 106, 108 to contact a media support surface 124 of primary media tray 32.

FIGS. 2 and 3 depict print media source 20, with primary print media 34 held in primary media tray 32, and secondary print media 38 held in secondary (or auxiliary) media tray 36. As best shown in FIG. 3, sheet picking roller 42 is biased in direction 92 to engage and pick upper media sheet 48 of secondary print media 38 held in secondary media tray 36, which in this case is the top sheet of print media 22 located in print media source 20.

In comparison, FIGS. 4 and 5 depict print media source 20, with primary print media 34 held in primary media tray 32, and with no secondary print media 38 held in secondary media tray 36, i.e., secondary media tray 36 is empty. As best shown in FIG. 5, sheet picking roller 42 is biased in direction 92 to engage and pick upper media sheet 46 of primary print media 34 held in primary media tray 32, which in this case is the top sheet of print media 22 located in print media source 20.

Referring to FIGS. 1, 3 and 5, sheet picking roller 42 is biased, such as by spring 90, in a direction 92 to engage the top sheet 44 of print media 22, regardless of which of primary media tray 32 and secondary media tray 36 contains the top sheet of print media 22. Thus, top sheet 44 of print media 22 is located in secondary media tray 36 when at least one sheet of secondary print media 38 is present (see FIG. 3), and top sheet 44 of print media 22 is located in primary media tray 32 when secondary media tray 36 is empty (see FIG. 5). Accordingly, with this embodiment, for example, primary media tray 32, secondary media tray 36 and sheet feeder mechanism 40 are arranged such that secondary media tray 36 must be empty before sheet picking roller 42 of sheet feeder mechanism 40 can engage a sheet, such as upper media sheet 46, of primary print media 34 held by primary media tray 32.

While this invention has been described with respect to an embodiment of the present invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a printing mechanism; and a print media source for supplying print media sheets to said printing mechanism, said print media source including:

a first media tray for holding a first print media;

a second media tray for holding a second print media;

a sheet feeder mechanism having a sheet picking roller located to pick a top sheet of print media in said print media source, said top sheet of print media being located in only one of said first media tray and said second media tray, said sheet feeder mechanism including a biasing mechanism coupled to said sheet picking roller, said sheet picking roller being biased by said biasing mechanism to move in a first direction to engage said top sheet of print media, regardless of which of said first media tray and said second media tray contains said top sheet of print media;

a first frame with a mounting frame coupled to said first frame, said mounting frame being located to extend across a width of said first media tray, said second media tray being pivotably coupled by at least one pivot joint to said mounting frame, wherein said mounting frame includes a cross support extending across a width of said first media tray; and a drive shaft for driving said sheet picking roller, said drive shaft being mounted to said cross support.

2. An imaging apparatus, comprising:

a printing mechanism;

a print media source for supplying print media sheets to said printing mechanism, said print media source including;

a first media tray for holding a first print media;

a second media tray for holding a second print media;

a sheet feeder mechanism having a sheet picking roller, said sheet feeder mechanism including a biasing mechanism coupled to said sheet picking roller, said sheet picking roller being biased by said biasing mechanism to move in a first direction to pick a sheet of print media from said first media tray and said sheet picking roller being biased in said first direction to pick a sheet of print media from said second media tray, and said first media tray and said second media tray being arranged such that said second print media tray must be empty before said sheet picking roller of said sheet feeder mechanism can engage a sheet of said first print media held by said first media tray; and a first frame with a mounting frame coupled to said first frame, said mounting frame being located to extend across a width of said first media tray, said second media tray being pivotably coupled by at least one pivot joint to said mounting frame.

3. The imaging apparatus of claim 2, wherein said second media tray pivots at said at least one pivot joint to contact an upper media sheet of said first print media in said first media tray.

4. The imaging apparatus of claim 2, wherein in the absence of said first print media in said first media tray, said second media tray pivots at said at least one pivot joint to contact a media support surface of said first media tray.

5. The imaging apparatus of claim 2, wherein said mounting frame includes a cross support extending across a width of said first media tray.

6. The imaging apparatus of claim 5, further comprising a drive shaft for driving said sheet picking roller, said drive shaft being mounted to said cross support.

* * * * *